US006759106B2

(12) United States Patent
Chu et al.

(10) Patent No.: US 6,759,106 B2
(45) Date of Patent: Jul. 6, 2004

(54) INK JET RECORDING ELEMENT

(75) Inventors: Lixin Chu, Rochester, NY (US); Lori J. Shaw-Klein, Rochester, NY (US); Kenneth J. Ruschak, Rochester, NY (US); Elizabeth A. Gallo, Penfield, NY (US); Christine M. Vargas, Churchville, NY (US); Charles R. Salerno, Newark, NY (US)

(73) Assignee: Eastman Kodak Company, Rochester, NY (US)

( * ) Notice: Subject to any disclaimer, the term of this patent is extended or adjusted under 35 U.S.C. 154(b) by 28 days.

(21) Appl. No.: 10/309,860

(22) Filed: Dec. 4, 2002

(65) Prior Publication Data

US 2004/0109956 A1 Jun. 10, 2004

(51) Int. Cl.[7] ..... B41M 5/00

(52) U.S. Cl. ..... 428/32.35; 428/32.29; 428/32.3; 428/32.34; 428/32.24; 428/32.25

(58) Field of Search ..... 428/32.24, 32.25, 428/32.29, 32.3, 32.34, 32.35

(56) References Cited

U.S. PATENT DOCUMENTS

| | | | |
|---|---|---|---|
| 5,700,582 | A | 12/1997 | Sargeant et al. |
| 5,965,244 | A | 10/1999 | Tang et al. |
| 6,114,022 | A | 9/2000 | Warner et al. |
| 6,140,406 | A | 10/2000 | Schliesman et al. |

FOREIGN PATENT DOCUMENTS

| | | | |
|---|---|---|---|
| EP | 0 739 747 | A2 | 4/1996 |

*Primary Examiner*—Pamela R. Schwartz
(74) *Attorney, Agent, or Firm*—Harold E. Cole

(57) ABSTRACT

An ink jet recording element having a support having thereon a porous image-receiving layer with at least 30% by weight of particles and at least 30% by weight of a binder, the particles being a mixture of a) silica gel particles having an average particle size of greater than about 9 $\mu$m in diameter; and b) silica gel particles having an average particle size of between 1 and about 8 $\mu$m in diameter; wherein the ratio of the a) silica gel particles to the b) silica gel particles is from about 0.5 to about 5.

20 Claims, No Drawings

INK JET RECORDING ELEMENT

FIELD OF THE INVENTION

This invention relates to an ink jet recording element, more particularly to a porous ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink.

The inks used in the various ink jet printers can be classified as either dye-based or pigment-based. A dye is a colorant that is dissolved in the carrier medium. A pigment is a colorant that is insoluble in the carrier medium, but is dispersed or suspended in the form of small particles, often stabilized against flocculation and settling by the use of dispersing agents. In either case, the carrier medium can be a liquid or a solid at room temperature. Commonly used carrier media include water, mixtures of water and organic co-solvents and high boiling organic solvents, such as hydrocarbons, esters, ketones, etc.

Dye-based inks and pigment-based inks behave differently when printed on porous recording elements. The dye molecules in dye-based inks are able to penetrate porous layers because they are much smaller than the pores at the surface of the recording element. However, pigment particles are often larger than the pores, and as a result, accumulate at the surface of the recording element even after the printed image is completely dry. The accumulated pigment particles form a layer on the surface that can crack if the surface is not smooth.

EP 0 739 747 A2 and U.S. Pat. Nos. 5,965,244; 6,114,022 and 6,140,406 relate to porous ink jet recording elements containing silica gel which are printed with dye-based inks. However, these recording elements are not suitable for printing with pigment-based inks because the pores at the surfaces are too small relative to pigment particles. In addition, the surfaces are too smooth such that layers formed from accumulated pigment particles crack.

U.S. Pat. No. 5,700,582 relates to the use of nonporous swellable recording elements for printing with pigment-based inks. However, these recording elements are not suitable for printing with pigment-based inks because it is difficult for pigment particles to diffuse into nonporous ink-receiving layers. Also, nonporous swellable recording elements dry slower than one would like.

It is an object of this invention to provide a porous ink jet recording element that has good image quality with an excellent dry time. It is another object of the invention to provide a porous ink jet recording element having a smooth surface that, when printed with pigment-based inks, does not cause cracking of layers formed by accumulated pigment particles.

SUMMARY OF THE INVENTION

These and other objects are achieved in accordance with the invention which comprises an ink jet recording element comprising a support having thereon a porous image-receiving layer comprising at least 30% by weight of particles and at least 30% by weight of a binder, the particles comprising a mixture of a) silica gel particles having an average particle size of greater than about 9 μm in diameter; and b) silica gel particles having an average particle size of between about 1 and about 8 μm in diameter;

wherein the ratio of the a) silica gel particles to the b) silica gel particles is about 0.05 to about 5.

By use of the invention, a porous ink jet recording element is obtained that has a good image quality with an excellent dry time. In addition, the ink jet recording element has a smooth surface that, when printed with pigment based inks, does not cause cracking of films formed by pigment particles that have accumulated at the surface of the recording element.

DETAILED DESCRIPTION OF THE INVENTION

As described above, the image-receiving layer is porous and contains a mixture of particles.

In a preferred embodiment, the a) silica gel particles have an average particle size of greater than about 10 μm in diameter. In another preferred embodiment, the b) silica gel particles have an average particle size of between about 2 and about 6 μm in diameter. The a) and b) silica gel particles are used in an amount of at least about 30 wt. %, preferably from about 40–60 wt. %.

Examples of a) silica gel particles which may be used in the invention include the following: Gasil® IJ45 (Ineos Co.), avg. particle size of 10.1 μm; Gasil® HP 39 (Ineos Co.), avg. particle size of 10.3 μm; Gasil® HP395 (Ineos Co.), avg. particle size of 14.5 μm; Syloid® C812 (Grace-Davison Co.), avg. particle size of 12 μm; Syloid® 620 (Grace-Davison Co.), avg. particle size of 12 μm; Sylojet® P409(Grace-Davison Co.), avg. particle size of 9 μm; Sylojet® P412 (Grace-Davison Co.), avg. particle size of 12 μm; Sylojet® P416 (Grace-Davison Co.), avg. particle size of 16 μm; and Mizukasil® P-78F (Mizusawa Industrial Chemicals, LTD. Co.), avg. particle size of 12.5 μm.

Examples of b) silica gel particles which may be used in the invention include the following: Gasil® IJ35 (Ineos Co.), avg. particle size of 4.5 μm; Gasil® IJ37 (Ineos Co.), avg. particle size of 5.8 μm; Gasil® HP210 (Ineos Co.), avg. particle size of 6.4 μm; Gasil® HP260 (Ineos Co.), avg. particle size of 6.6 μm; Sylojet® P403 (Grace-Davison Co.), avg. particle size of 3 μm; Sylojet® P405(Grace-Davison Co.), avg. particle size of 5 μm; Sylojet® P407 (Grace-Davison Co.), avg. particle size of 7 μm; Mizukasil® P-78A (Mizusawa Industrial Chemicals, LTD. Co.), avg. particle size of 3.3 μm; and Mizukasil® P-78D (Mizusawa Industrial Chemicals, LTD. Co.), avg. particle size of 7.0 μm.

The image-receiving layer also comprises a hydrophilic polymer that functions as a binder for the silica gel particles.

The binder is used in an amount that imparts cohesive strength to the layer, but should also be minimized so that the layer is porous, i.e., has interconnecting voids so that the carrier medium of an ink jet ink used in printing on the recording element can travel through the image-receiving layer to a support or base layer if one is present. The amount of hydrophilic binder is at least about 30 wt. %, preferably from about 40–60 wt. %.

In a preferred embodiment of the invention, the binder is poly(vinyl alcohol), poly(vinyl pyrrolidone), gelatin, a cellulose ether, a poly(oxazoline), a poly(vinylacetamide), a partially hydrolyzed poly(vinyl acetate/vinyl alcohol), a poly(acrylic acid), a poly(acrylamide), a poly(alkylene oxide), a sulfonated or phosphated polyester, polystyrene, casein, zein, albumin, chitin, chitosan, dextran, pectin, collagen derivatives, collodian, agar-agar, arrowroot, guar, carrageenan, tragacanth, xanthan, rhamsan and the like. In another preferred embodiment, the hydrophilic polymer is poly(vinyl alcohol). The hydrophilic polymer should be chosen so that it is compatible with the aforementioned a) and b) silica gel particles.

The image-receiving layer of the invention may optionally comprise one or more mordants in order to improve water and humidity resistance. Such mordants are well known in the art of ink jet printing and typically comprise a water soluble or water dispersible cationic polymer. Any mordant can be used in the image-receiving layer provided it does not adversely affect the permanence of dye or pigment colorants which have been printed on the recording element. The amount of mordant is at least about 2 wt. %, preferably from about 5–10 wt %.

Mordants useful in the invention include cationic polymers wherein the cationic group is derived from a primary, secondary, or tertiary amino group, or a quaternary ammonium group. The cationic polymers may be addition polymers or condensation polymers. Examples include cationic derivatives of: poly(diallyldimethylamine), poly(ethyleneimine), poly(vinyl pyridine), poly(vinyl imidazole), poly(vinyl alcohol), gelatin, chitosan, poly(amide-epichlorohydrin), polyacrylamide, poly(dialkylaminoethyl methacrylate), poly(dialkylaminoethyl acrylate), poly(dialkylaminoethyl methacrylamide), poly(dialkylaminoethyl acrylamide), polyepoxyamine, polyamideamine, dicyandiamide-formaldehyde polycondensation products, dicyandiamidepolyalkylpolyalkylenepolyamine polycondensation products, polyamine-sulfone, poly(vinyl amine), poly(alkylene oxides, and poly(allyl amine).

In general, mordants can be prepared from any ethylenically unsaturated cationic monomer. Examples include trimethyl-(2-acrylamido-2,2-dimethylethyl)ammonium chloride, trimethyl-(3-acrylamido-3,3-dimethylpropyl) ammonium chloride, N-vinyl imidazole, N-vinyl-2-methyl imidazole, N-(3-dimethylaminopropyl) methacrylamide, hydroxyethyl trimethyl ammonium chloride, trimethyl (methacrylamidopropyl)ammonium chloride, and N-(1,1-dimethyl-3-dimethylaminopropyl) methacrylamide.

In a preferred embodiment of the invention, the mordant comprises a cationic polymer that is a salt of trimethylvinylbenzylammonium, benzyldimethylvinylbenzylammonium, dimethyloctadecylvinylbenzylammonium, glycidyltrimethylammonium, 1-vinyl-3-benzylimidazolium, 1-vinyl-3-hydroxyethylimidazolium or 4-hydroxyethyl-1-vinylpyridinium. Preferred counterions that can be used include chlorides or other counterions as disclosed in U.S. Pat. Nos. 5,223,338; 5,354,813, and 5,403,955, the disclosures of which are hereby incorporated by reference.

In another preferred embodiment of the invention, water soluble mordants which can be used are described in EP 1 002 660 A1, the disclosure of which is incorporated herein by reference. In another preferred embodiment of the invention, water dispersible mordants which can be used are described in U.S. patent application Ser. No. 09/770,814, filed Jan. 26, 2001, the disclosure of which is incorporated herein by reference. In another preferred embodiment of the invention, the image-receiving layer comprises poly (diallyldimethylammonium) chloride.

The thickness of the image-receiving layer may range from about 3 to about 40 $\mu$m, preferably from about 5 to about 20 $\mu$m. The thickness required is determined through the need for the image-receiving layer to act as a sump for absorption of ink carrier media. The recording element of the invention may consist of a single layer coated on a support wherein the single layer is the image-receiving layer containing the a) and b) silica gel particles. The recording element may also consist of a multi-layer structure coated on a support wherein any one of the layers is the image-receiving layer containing the a) and b) silica gel particles.

The support for the ink jet recording element of the invention can be any of those usually used for ink jet recording elements, such as resin-coated paper, paper, polyesters, microporous materials such as polyethylene polymer-containing material sold as Teslin® (PPG Industries, Inc.), Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

The image-receiving layer containing the a) and b) silica gel particles may be coated on the support using any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. After coating, the image-receiving layer is dried by simple evaporation, which may be accelerated by known techniques such as convection heating. The solids content of the coating composition for the image-receiving layer is typically between 10 and 60 wt. % and depends upon the coating method employed.

In order to impart mechanical durability to the image-receiving layer, crosslinkers may be added in small quantities. Crosslinkers chemically react with the hydrophilic binder discussed above, thereby improving the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include adhesion promoters, rheology modifiers, biocides, lubricants, dyes, optical brighteners, matte agents, antistatic agents, etc.

In addition to the image-receiving layer, the recording element may also contain other base layers, next to the support, the function of which is to absorb the carrier medium of the ink. For example, the recording element of the invention may have a base layer in between the image-receiving layer and the support. Materials useful for base layers include inorganic particles and binder, preferably at least about 40 wt. % of inorganic particles and less than about 10 wt. % of a binder. Inorganic particles include calcium carbonate, magnesium carbonate, barium sulfate, silica, alumina, boehmite, hydrated alumina, clay or titanium oxide. In a preferred embodiment of the invention, the inorganic particles are negatively charged. Binders useful in base layers include the same binders listed above for use in the image-receiving layer as well as latex polymers. For example, the binder used in a base layer may be poly(vinyl alcohol) and/or styrene-butadiene latex.

Ink jet inks used to image the recording elements of the present invention are well known in the art. The ink compositions used in ink jet printing may be dye-based or pigment-based, and typically are liquid compositions comprising a solvent or carrier medium, humectants, organic solvents, detergents, thickeners, preservatives, and the like. The solvent or carrier medium can be solely water or can be water mixed with other water-miscible solvents such as polyhydric alcohols. Inks in which organic materials such as polyhydric alcohols are the predominant solvent or carrier medium may also be used. Particularly useful are mixed solvents of water and polyhydric alcohols.

Although the recording elements disclosed herein have been referred to primarily as being useful for ink jet printers, they also can be used as recording elements for pen plotter assemblies. Pen plotters operate by writing directly on the surface of a recording element using a pen consisting of a bundle of capillary tubes in contact with an ink reservoir.

The following example further illustrates the invention.

EXAMPLE

Element 1 of the Invention

A coating composition was prepared by mixing together 28 g of 6 μm silica gel Gasil® 23F (Ineos Co.) and 7 g of 10 μm silica gel Gasil® HP39 (Ineos Co.) in a glass container. Then, 140 g of water was added, followed by 5 g of poly(diallyldimethylammonium chloride) (Nalco® CP-261) and 60 g of poly(vinyl alcohol) (Nippon Gohsei® GH03). The mixture was further diluted with water under vigorous stirring to give a coating composition of 25 wt. % solids.

The coating composition was coated at 25° C. on paper using a hand-coating device with a Meyer rod so that the final dry thickness of the image-receiving layer was about 10 g/m$^2$. The paper was Nekoosa Solutions Smooth®, Grade 5128, Carrara White®, Color 9220, (Georgia Pacific Co.) having a basis weight of 150 g/m$^2$. After the composition was coated, it was immediately dried in an oven at 60° C.

Element 2 of the Invention

This element was prepared the same as Element 1 of the Invention except that 17.5 g of silica gel Gasil® 23F was mixed with 17.5 g of silica gel Gasil® HP39.

Element 3 of the Invention

This element was prepared the same as Element 1 of the Invention except that 10 g of silica gel Gasil® 23F was mixed with 25 g of silica gel Gasil® HP39.

Comparative Element C-1 (Only One Silica Gel)

This element was prepared the same as Element 1 of the Invention except that 35 g of silica gel Gasil® 23F was used and no silica gel Gasil® HP39 was used.

Comparative Element C-2 (Only One Silica Gel)

This element was prepared the same as Element 1 of the Invention except that no silica gel Gasil® 23F was used and 35 g of silica gel Gasil® HP39 was used.

Comparative Element C-3 Only One Silica Gel)

This element was prepared the same as Element 1 of the Invention except that only 35 g of 14.5 μm silica gel Gasil® HP395 (Ineos Co.) was used instead of Gasil® 23F and Gasil® HP39.

Printing

Images were printed on the above recording elements using a Hewlett-Packard DesignJet® 5000 printer with a pigment-based ink set available as Hewlett-Packard 5000 UV Inks having catalogue numbers C-4940A, C-4941A, C-4942A, and C-4943A. The images comprised a series of rectangles of cyan, magenta, yellow, black, green, red and blue patches and a combination of black with the above color patches. Each rectangle was 0.8 cm in width and 1.2 cm in length.

Testing

Cracking was evaluated for printed rectangles formed by the yellow, magenta and black inks in the same rectangle as follows:

1=no cracks

2=cracks seen under 5× microscope

3=cracks seen by naked eye

The results are shown in the Table below.

Sheffield Smoothness

Surface smoothness was measured in Sheffield Units by using a Sheffield Precitionaire® equipped with a "Porosimeter" and "Smoothcheck" head. For each recording element, five measurements were obtained and the average is reported in the Table below. Lower values indicate a smoother surface relative to those with higher values.

TABLE

| Recording Element | Sheffield Smoothness (Sheffield Units) | Cracking |
|---|---|---|
| 1 | 147 | 2 |
| 2 | 184 | 1 |
| 3 | 218 | 1 |
| C-1 | 145 | 3 |
| C-2 | 236 | 1 |
| C-3 | 264 | 1 |

The above data show that Recording Elements 1, 2 and 3 of the invention had acceptable combinations of Sheffield Units and cracking, as compared to Comparative Elements C-1, C-2 and C-3.

The invention has been described in detail with particular reference to certain preferred embodiments thereof, but it will be understood that variations and modifications can be effected within the spirit and scope of the invention.

What is claimed is:

1. An ink jet recording element comprising a support having thereon a porous image-receiving layer comprising at least 30% by weight of particles and at least 30% by weight of a binder, said particles comprising a mixture of a) silica gel particles having an average particle size of greater than about 9 μm in diameter; and b) silica gel particles having an average particle size of between about 1 and about 8 μm in diameter;

wherein the ratio of the a) silica gel particles to the b) silica gel particles is about 0.05 to about 5.

2. The recording element of claim 1 wherein said a) silica gel particles have an average size of greater than about 10 μm in diameter.

3. The recording element of claim 1 wherein said b) silica gel particles have an average size of between about 2 and about 6 μm in diameter.

4. The recording element of claim 1 wherein said particles are present in an amount of from about 40 wt. % to about 60 wt. %.

5. The recording element of claim 1 wherein said binder is present in an amount of from about 40 wt. % to about 60 wt. %.

6. The recording element of claim 1 wherein said binder is a hydrophilic polymer.

7. The recording element of claim 1 wherein said binder is poly(vinyl alcohol), poly(vinyl pyrrolidone), gelatin, a cellulose ether, a poly(oxazoline), a poly(vinylacetamide), a partially hydrolyzed poly(vinyl acetate/vinyl alcohol), a poly(acrylic acid), a poly(acrylamide), a poly(alkylene oxide), a sulfonated or phosphated polyester or a polystyrene.

8. The recording element of claim 1 further comprising a mordant.

9. The recording element of claim 8 wherein said mordant comprises a cationic group derived from a primary, secondary, or tertiary amino group, or a quaternary ammonium group.

10. The recording element of claim 8 wherein said mordant is present in an amount of at least 2 wt. %.

11. The recording element of claim 1 further comprising a water soluble cationic polymer or a water dispersible cationic polymer.

12. The recording element of claim 1 further comprising poly(diallyldimethylammonium) chloride.

13. The recording element of claim 12 wherein said poly(diallyldimethylammonium) chloride is present in an amount of at least 2 wt. %.

14. The recording element of claim 1 wherein said image-receiving layer has a thickness of from about 3 to about 40 μm.

15. The recording element of claim 1 wherein a base layer is present between said image-receiving layer and said support.

16. The recording element of claim 1 wherein said base layer comprises at least about 40 wt. % of inorganic particles and less than 10 wt. % of a binder.

17. The recording element of claim 16 wherein said inorganic particles comprise calcium carbonate, magnesium carbonate, barium sulfate, silica, alumina, boehmite, hydrated alumina, clay or titanium oxide.

18. The recording element of claim 16 wherein said inorganic particles in said base layer are negatively charged.

19. The recording element of claim 16 wherein said binder in said base layer comprises a polymeric material and/or a latex material.

20. The recording element of claim 19 wherein said binder in said base layer is poly(vinyl alcohol) and/or styrene-butadiene latex.

* * * * *